US011116280B2

(12) United States Patent
Champagne et al.

(10) Patent No.: US 11,116,280 B2
(45) **Date of Patent: *Sep. 14, 2021**

(54) SKATE BOOT HAVING AN INNER LINER WITH AN ABRASION RESISTANT OVERLAY

(71) Applicant: BAUER HOCKEY, LLC., Exeter, NH (US)

(72) Inventors: Gaetan Champagne, Saint-Colomban (CA); Jean-Marie Bidal, St-Jerome (CA); Donald Nault, St-Jerome (CA); Stephane Chalifoux, Blainville (CA)

(73) Assignee: BAUER HOCKEY, LLC, Exeter, NH (US)

( * ) Notice: Subject to any disclaimer, the term of this patent is extended or adjusted under 35 U.S.C. 154(b) by 137 days.

This patent is subject to a terminal disclaimer.

(21) Appl. No.: 15/952,681

(22) Filed: Apr. 13, 2018

(65) Prior Publication Data

US 2018/0228245 A1 Aug. 16, 2018

Related U.S. Application Data

(63) Continuation of application No. 15/212,844, filed on Jul. 18, 2016, now abandoned, which is a (Continued)

(51) Int. Cl.
*A43B 5/16* (2006.01)
*A43B 7/20* (2006.01)
(Continued)

(52) U.S. Cl.
CPC ..... *A43B 5/1683* (2013.01); *A43B 5/1666* (2013.01); *A43B 5/1691* (2013.01);
(Continued)

(58) Field of Classification Search
CPC ..... A43B 5/0401; A43B 5/16; A43B 5/0405; A43B 5/1666; A43B 5/1616; A43B 5/1625; A43B 23/0325
See application file for complete search history.

(56) References Cited

U.S. PATENT DOCUMENTS 2,211,822 A * 8/1940 Jennings ..... A43B 5/1691 36/71
3,834,377 A * 9/1974 Lebold ..... A43B 3/16 602/27

(Continued)

FOREIGN PATENT DOCUMENTS

| | | |
|---|---|---|
| CN | 201878904 U | 6/2011 |
| EP | 1384568 A1 | 2/2006 |
| WO | 199829000 A1 | 7/1998 |

OTHER PUBLICATIONS

Non-Final Office Action dated Apr. 21, 2015 in connection with U.S. Appl. No. 14/041,784, 13 pages.

(Continued)

*Primary Examiner* — Shaun R Hurley
*Assistant Examiner* — Bao-Thieu L Nguyen

(57) ABSTRACT

A liner for a skate boot that includes an outer surface and an inner surface. The outer surface is configured to be mounted to a shell of the skate boot. The inner surface includes a first material and an overlay of a second material covering a part of the first material. The overlay and another part of the first material not covered by the second material are configured to be exposed to a foot when the foot is placed in the skate boot.

23 Claims, 12 Drawing Sheets

Related U.S. Application Data continuation of application No. 14/041,784, filed on Sep. 30, 2013, now Pat. No. 9,392,840.

(51) Int. Cl.
*A43B 23/02* (2006.01)
*A43B 23/17* (2006.01)

(52) U.S. Cl.
CPC ..... *A43B 7/20* (2013.01); *A43B 23/026* (2013.01); *A43B 23/0235* (2013.01); *A43B 23/17* (2013.01)

(56) References Cited

U.S. PATENT DOCUMENTS 4,385,456 A * 5/1983 Livernois ..... A43B 3/0047 36/115
5,449,005 A * 9/1995 Echols ..... A43B 7/20 128/882
5,894,684 A * 4/1999 Sand ..... A43B 7/20 36/115
5,924,218 A 7/1999 Dalvy et al.
6,012,726 A * 1/2000 Grande ..... A43B 7/20 280/11.221
6,018,892 A * 2/2000 Acheson ..... A43B 5/1683 36/115
6,079,128 A * 6/2000 Hoshizaki ..... A43B 23/16 36/115
6,550,159 B1 * 4/2003 Madore ..... A43B 5/1691 280/11.18
6,769,203 B1 * 8/2004 Wright ..... A43B 5/1666 36/115
6,793,640 B1 * 9/2004 Avon ..... A61F 5/0111 602/23
6,871,424 B2 * 3/2005 Labonte ..... A43B 5/1666 36/115
7,316,083 B2 * 1/2008 Labonte ..... A43B 5/1666 264/154
7,373,742 B2 * 5/2008 Murphy ..... A43B 5/1616 36/115
7,533,479 B2 * 5/2009 LaBonte ..... A43B 5/1683 36/114
7,950,676 B2 * 5/2011 Goldsmith ..... A43B 5/1625 280/11.12
8,245,419 B2 * 8/2012 Echols ..... A43B 23/0285 36/114
8,387,286 B2 * 3/2013 Koyess ..... A43B 5/1616 36/115
9,392,840 B2 * 7/2016 Champagne ..... A43B 5/1666
2004/0016150 A1 * 1/2004 Labonte ..... A43B 5/1666 36/115
2004/0083625 A1 * 5/2004 Wilder ..... A43B 5/1666 36/115
2005/0116379 A1 * 6/2005 Goldsmith ..... A43B 5/1625 264/222
2005/0138849 A1 * 6/2005 Morrow ..... A43B 5/0401 36/117.1
2005/0193594 A1 * 9/2005 Murphy ..... A43B 5/1616 36/89
2005/0210709 A1 * 9/2005 Labonte ..... A43B 5/1666 36/89
2006/0053654 A1 * 3/2006 Tingle ..... A43B 3/0031 36/2.6
2006/0053662 A1 * 3/2006 Yang ..... A43B 5/1625 36/115
2006/0179686 A1 * 8/2006 Labonte ..... A43B 5/1691 36/89
2007/0294920 A1 12/2007 Baychar
2008/0172906 A1 * 7/2008 Jou ..... A43B 5/1666 36/115
2010/0156058 A1 * 6/2010 Koyess ..... A43B 5/1616 280/11.12
2011/0173841 A1 * 7/2011 McDuff ..... A43B 7/085 36/89
2013/0119580 A1 * 5/2013 Yang ..... B29C 45/14475 264/279
2014/0013621 A1 * 1/2014 Dupree ..... A43B 3/242 36/100
2014/0097583 A1 * 4/2014 Vaughn ..... A63C 1/303 280/11.12
2014/0252736 A1 * 9/2014 Lefebvre ..... A43B 5/1625 280/11.12
2014/0259793 A1 * 9/2014 Labonte ..... A43B 5/1666 36/115
2014/0259794 A1 * 9/2014 Labonte ..... A43B 5/1683 36/115
2015/0028576 A1 * 1/2015 Schatz ..... A43B 5/18 280/816
2015/0143716 A1 * 5/2015 Long ..... A43B 1/04 36/83

OTHER PUBLICATIONS

Final Office Action dated Sep. 22, 2015 in connection with U.S. Appl. No. 14/041,784, 16 pages.
Advisory Action dated Jan. 13, 2016 in connection with U.S. Appl. No. 14/041,784, 3 pages.
Notice of Allowance dated Mar. 31, 2016 in connection with U.S. Appl. No. 14/041,784, 8 pages.
Examiner's Report dated Oct. 6, 2016 in connection with Canadian Patent Application No. 2,828,938, 4 pages.
Examiner's Report dated Feb. 15, 2017 in connection with Canadian Patent Application No. 2,828,938, 3 pages.
Examiner's Report dated May 24, 2017 in connection with Canadian Patent Application No. 2,828,938, 4 pages.
Examiner's Report dated Aug. 3, 2017 in connection with Canadian Patent Application No. 2,828,938, 3 pages.
Non-Final Office Action dated Dec. 13, 2017 in connection with U.S. Appl. No. 15/212,844, 14 pages.
Mod Squad Hockey, http://modsquadhockey.com/forums/index.php2/topic/64035-ccm-rbz-skate-initial-thoughts/, Jul. 5, 2013, 18 pages.
Hockey World Blog, http://www.hockeyworldblog.com/2012/02/06/reebok-18k-ice-hockey-skates/, Feb. 10, 2012, 3 pages.
Hockey World Blog, http://www.hockeyworldblog.com/2013/03/15/easton-mako-skates-review-initial-impressions/, Mar. 15, 2013, 6 pages.
On the Ice: Easton Mako skates | Great Skate Hockey—Blog, http://blog.greatskate.com/on-the-ice-easton-makoskates/, Jun. 11, 2013, 4 pages.
Hockey World Blog, http://www.hockeyworldblog.com/2013/01/22/graf-ultra-g9035-skates/, May 26, 2014, 9 pages.
Examiner's Report dated Nov. 24, 2020 in connection with Canadian patent application No. 2,984,944, 3 pages.

* cited by examiner

SKATE BOOT HAVING AN INNER LINER WITH AN ABRASION RESISTANT OVERLAY

CROSS-REFERENCE TO RELATED APPLICATIONS

This application is a continuation of U.S. patent application Ser. No. 15/212,844, filed on Jul. 18, 2016, which is a continuation of U.S. patent application Ser. No. 14/041,784, filed on Sep. 30, 2013, now U.S. Pat. No. 9,392,840. The contents of the aforementioned application are incorporated by reference herein.

FIELD OF THE INVENTION

The present invention relates to a skate boot having an inner liner with an abrasion resistant cover, layer, patch, or overlay made of a material that has more abrasion resistance than the remaining material of the inner liner.

BACKGROUND OF THE INVENTION

As is well known in the art, a skate boot for an ice hockey or roller hockey player may comprise an outer shell made of different layers and an inner liner or inner lining for covering the inner surface of the outer shell. The inner liner has an outer surface that is mounted to the inner surface of the outer shell and an inner surface adapted to contact the player's foot or the sock covering the player's foot.

The inner liner may be made of a layer of soft material such as a sheet of polyester laminated with a layer of foam, or of a layer of fabric made from nylon fibers.

Because of the repetitive flexing motions in the ankle region of the hockey player, the hockey sock covering the leg pad worn by the player and/or the boot tongue repetitively contact the upper medial and lateral inner regions of the inner liner and these portions are therefore exposed to much more friction and may eventually be partially or entirely be torn, abraded or damaged. This constant rubbing of the tongue and/or leg pad covered by the hockey sock is mostly concentrated to the upper medial and lateral inner regions of the inner liner around the first and second lace openings or eyelets of the skate boot, extending backwards from the lace openings or eyelets a few centimeters depending on the size of the skate boot.

There is therefore a need in the industry for a skate boot having an inner liner that has one or more overlays, coverings, layers or patches provided on the upper inner regions of the inner liner and made of a material that has more abrasion resistance than the remaining material of the inner liner.

SUMMARY OF THE INVENTION

As embodied and broadly described herein, according to a broad aspect, the invention provides a skate boot for enclosing a foot of a hockey player, the player's foot having a heel, an ankle with a medial side and a lateral side, and medial and lateral sides, the skate boot comprising: (a) an outer shell having outer and inner surfaces, the outer shell comprising a heel portion for receiving the heel of the player's foot, an ankle portion for receiving the ankle of the player's foot, the ankle portion of the outer shell comprising a medial side having a medial upper edge and a lateral side having a lateral upper edge, and medial and lateral side portions for receiving the medial and lateral sides of the player's foot; and (b) an inner liner made of a first material and comprising an outer surface mounted to the inner surface of the outer shell, an inner surface adapted to contact the player's foot or a sock covering the player's foot, an ankle portion comprising a medial upper edge, a medial upper inner region, a lateral upper edge and a lateral upper inner region, wherein one of the medial and lateral upper inner regions of the inner liner comprises an overlay made of a second material having more abrasion resistance than the first material of the inner liner.

According to another broad aspect, the invention provides a skate boot for enclosing a foot of a hockey player, the player's foot having a heel, an ankle with a medial side and a lateral side, and medial and lateral sides, the skate boot comprising: (a) an outer shell having outer and inner surfaces, the outer shell having a heel portion for receiving the heel of the player's foot, an ankle portion for receiving the ankle of the player's foot, the ankle portion of the outer shell comprising a medial side having a medial upper edge and a lateral side having a lateral upper edge, and medial and lateral side portions for receiving the medial and lateral sides of the player's foot; and (b) an inner liner made of a first material and comprising an outer surface mounted to the inner surface of the outer shell, an inner surface adapted to contact the player's foot or a sock covering the player's foot, an ankle portion comprising a medial upper inner region and a lateral upper inner region, and an overlay at least partially covering one of the medial and lateral upper inner regions of the ankle portion of the inner liner, the overlay being made of a second material having more abrasion resistance than the first material of the inner liner.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of the embodiments of the present invention is provided herein below, by way of example only, with reference to the accompanying drawings, in which.

Figure 1:
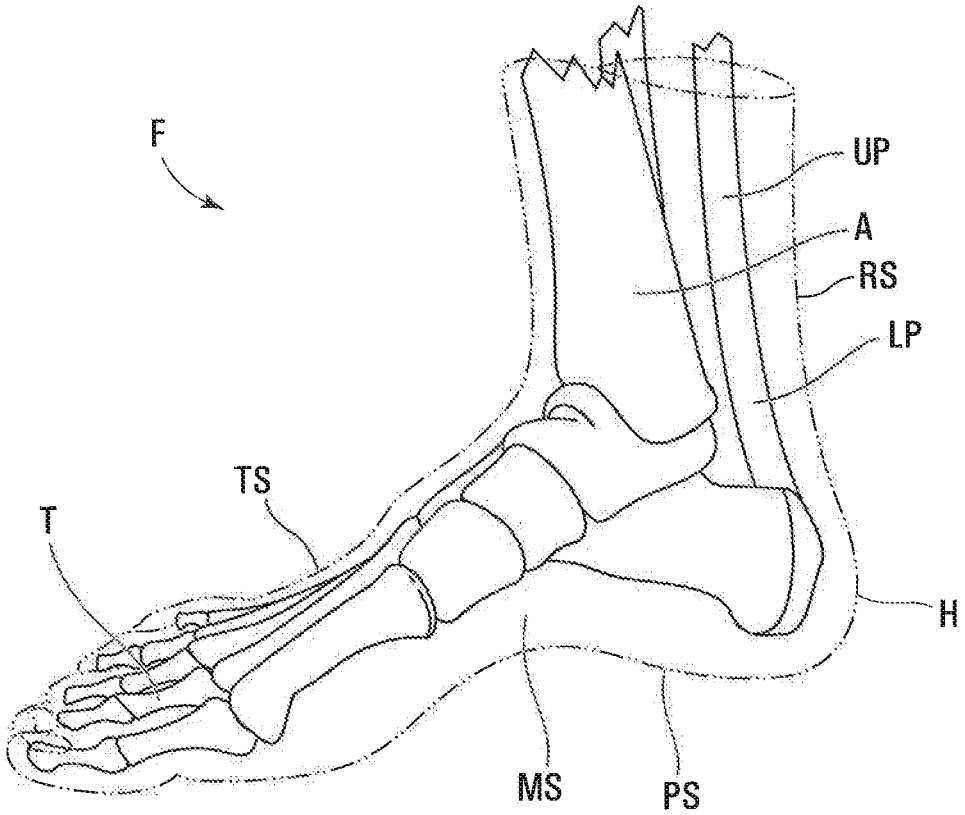
FIG. 1 is a side view of a right human foot with the integument of the foot shown in dotted lines and the bones shown in solid lines.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the to specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
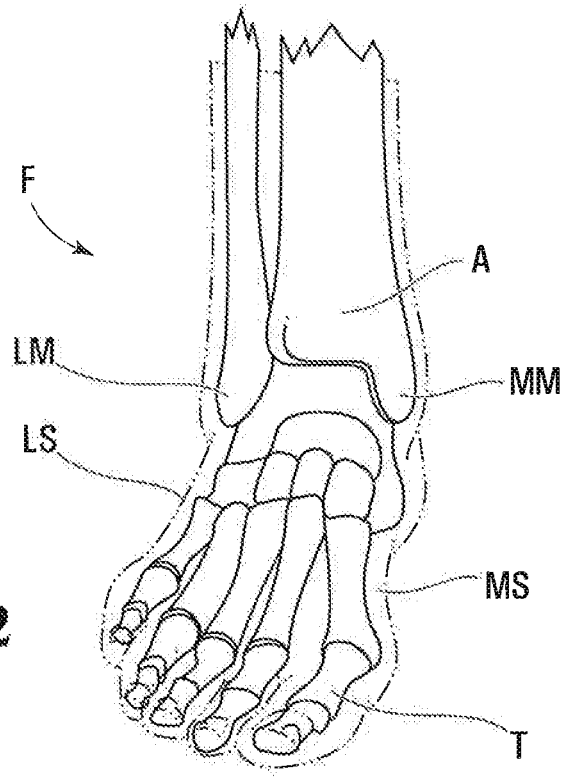
FIG. 2 is a front view of the human foot of FIG. 1.

Shown in FIGS. 1 and 2 is a typical right human foot F that includes toes T, a plantar surface PS, a top surface TS, a medial side MS and a lateral side LS. In addition, the human foot includes a heel H, and an ankle A having a medial side with and a medial malleolus MM, a rear side RS and a lateral side with a lateral malleolus LM, the lateral malleolus LM being at a lower position than the medial malleolus MM. The rear side RS has an upper part UP and a lower part LP projecting outwardly with relation to the upper part UP, the lower part merging with the heel H.

Figure 3:
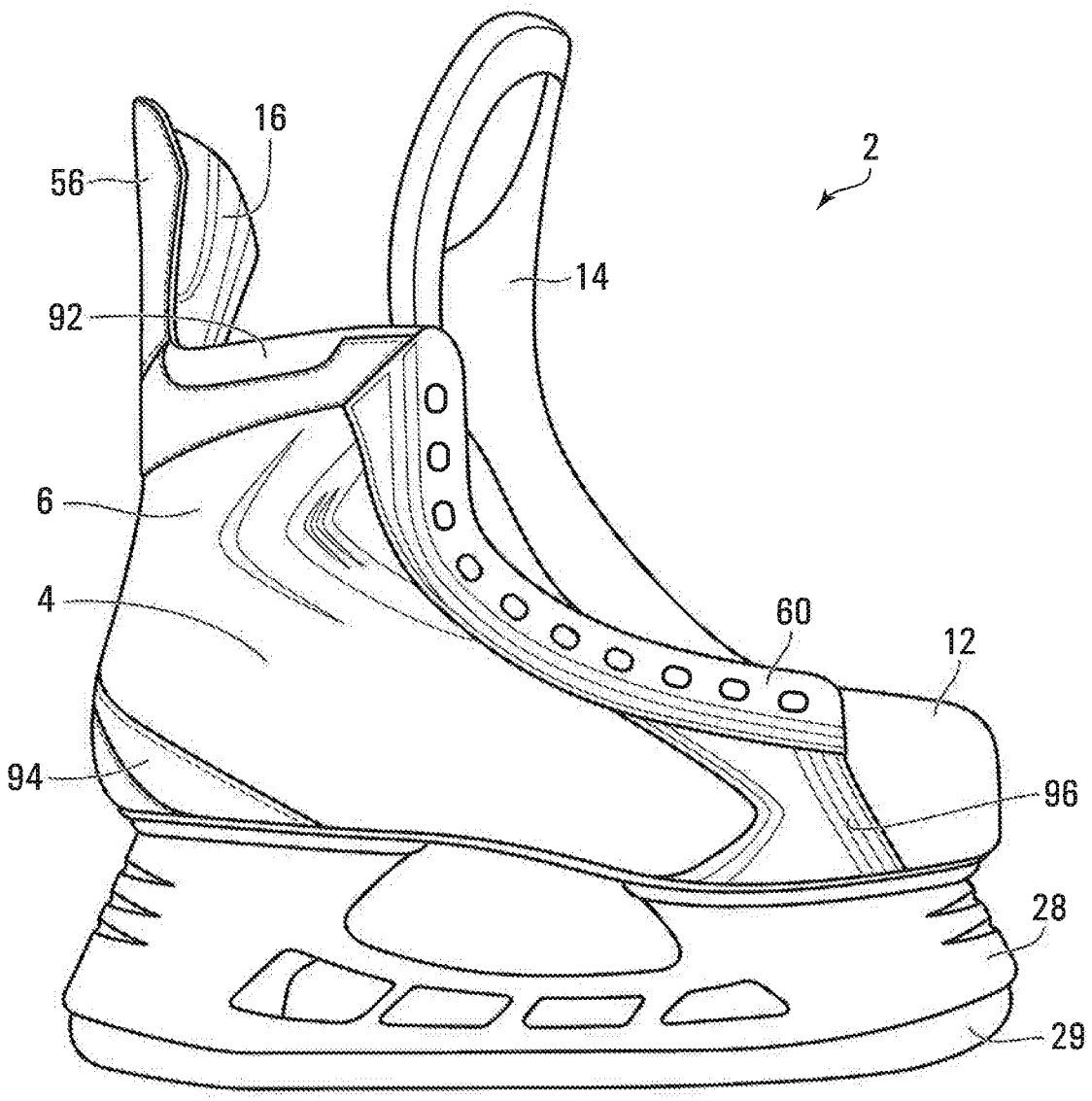
FIG. 3 is a side view of an ice skate having a skate boot with an inner liner in accordance with a first embodiment of the present invention.
Figure 4:
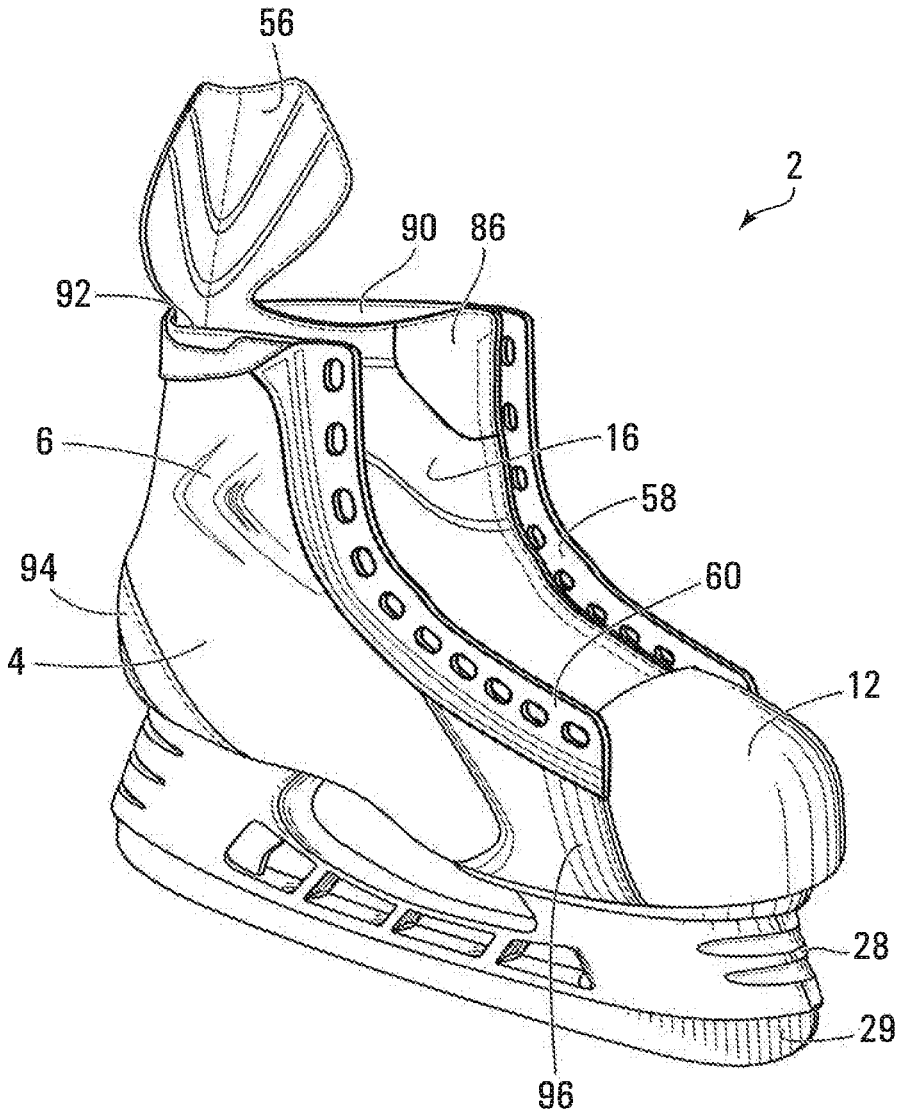
FIG. 4 is a perspective view of the ice skate of FIG. 3, shown without the tongue in order to better show the inner liner in accordance with the first embodiment of the present invention.
Figure 5:
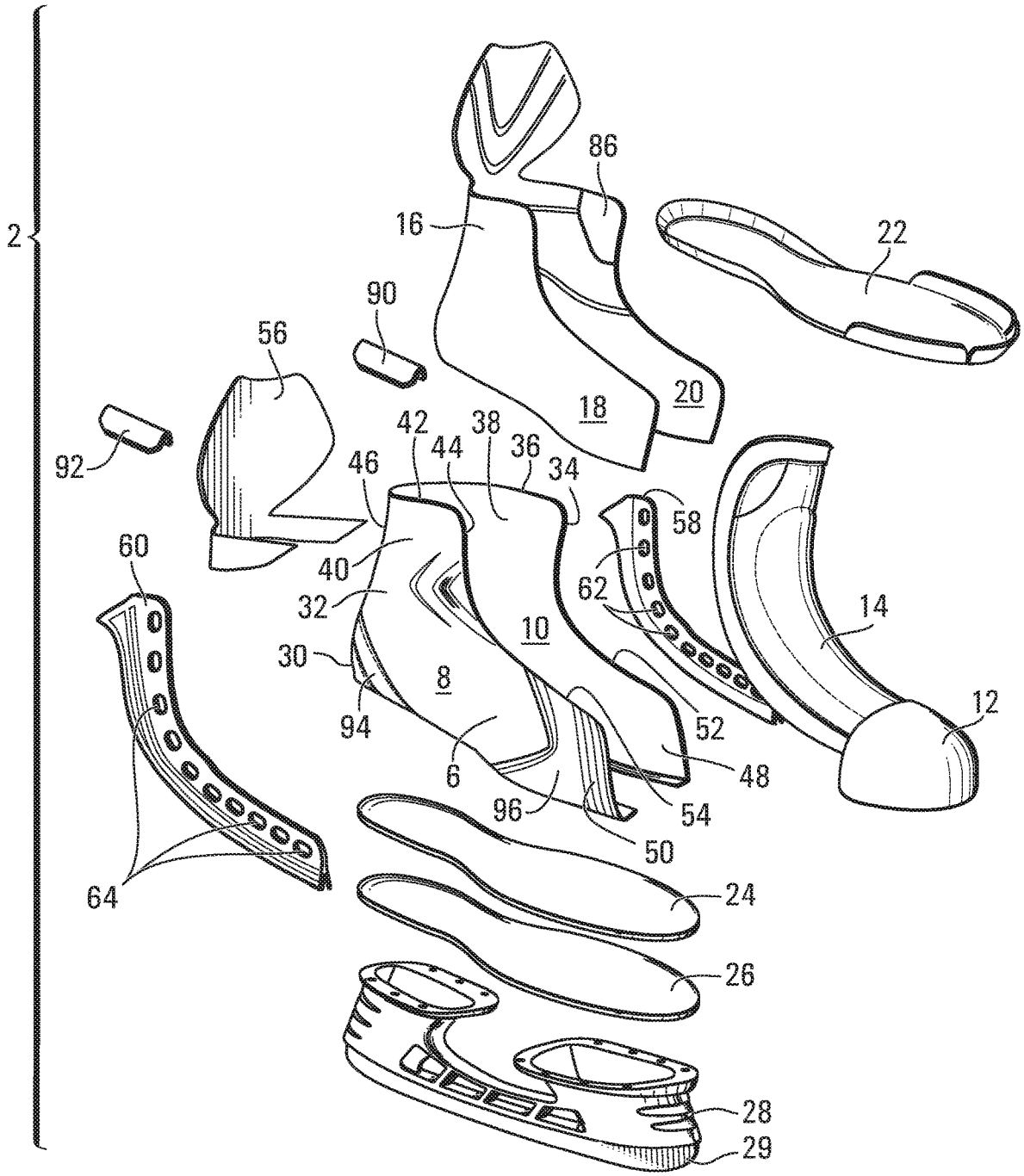
FIG. 5 is an exploded perspective view of the ice skate of FIG. 3.

Shown in FIGS. 3 to 5 is an ice skate 2 that comprises a skate boot 4 suitable for enclosing the foot of a hockey player. Although the skate boot 4 shown in the figures is being used for an ice skate, it is understood that the skate boot 4 could also be used for a roller hockey skate.

The skate boot 4 has an outer shell 6 for receiving the player's foot, the outer shell 6 having an outer surface 8 and an inner surface 10, a toe cap 12 made of a rigid material for protecting the player's toes, a tongue 14 extending upwardly and rearwardly from the toe cap 12 for covering a forefoot of the player's foot, an inner liner 16 having an outer surface 18 mounted to the inner surface 10 of the outer shell 6 and an inner surface 20 adapted to contact the player's foot or a sock covering the player's foot, a footbed 22, an insole 24, an outsole 26, an ice skate blade holder 28 and an ice skate blade 29. The footbed 22 has an upper surface for facing the plantar surface of the player's foot. The outsole 26 has an upper surface on which the sole portion of the outer shell 6 (e.g. the insole 24) may be affixed and a lower surface on which the blade holder 28 is mounted.

The outer shell 6 may be made of a thermoformable material. As used herein, the expression "thermoformable material" refers to a material that is capable of softening when heated and of hardening again when cooled. Some non-limiting examples of different types of thermoformable material comprise ethylene vinyl acetate (EVA) foam, polyethylene foam, polystyrene foam, polypropylene foam and thermoformable materials sold under the trade-marks MEGABIX®, SURLYN®, SONTARA®, FORMO500®, BYLON®, MOSOCA® and NYLON® 66.

The outer shell 6 is thermoformed such that it comprises a heel portion 30 for receiving the heel of the player's foot, an ankle portion 32 for receiving the ankle of the player's foot, the ankle portion 32 comprising a medial side 34 having a medial upper edge 36 and a medial upper region 38, a lateral side 40 having a lateral upper edge 42 and a lateral upper region 44, and a rear portion 46 for receiving the rear side of the ankle, and medial and lateral side portions 48, 50 for receiving the medial and lateral sides of the player's foot, the medial and lateral side portions 48, 50 having medial and lateral upper edges 52, 54. The medial and lateral side portions 48, 50 of the outer shell 6 extend forwardly from the heel and ankle portions 30, 32. The heel portion 30, ankle portion 32 and medial and lateral side portions 48, 50 form a foot-receiving cavity that conforms to the general shape of the player's foot.

The heel portion 30 of the outer shell 6 may be thermoformed such that it is substantially cup-shaped for following the contour of the player's heel.

The medial side 34 of the ankle portion 32 of the outer shell 6 may have a medial cup-shaped depression for receiving the medial malleolus and the lateral side 40 of the ankle portion 32 of the outer shell 6 may have a lateral cup-shaped depression for receiving the lateral malleolus. The lateral depression is located slightly lower than the medial depression for conforming to the morphology of the player's foot.

The rear portion 46 of the ankle portion 32 may be thermoformed such that it follows the lower part of the rear side of the player's foot.

The medial and lateral side portions 48, 50 of the outer shell 6 may be thermoformed such that they each define an inner surface that generally follows the contour of the side of the player's foot.

The outer shell 6 also comprises a tendon guard 56 for facing at least partially the upper part of the rear side of the ankle. The tendon guard 56 allows backwards flexion of the ankle when the player's foot moves towards full extension. The tendon guard 56 may be made of silicone or may be made by injection molding using polyester, polyurethane, polyamide, or other suitable thermoplastics. The selected material may have enough flexibility to allow the tendon guard 56 to flex rearwardly when pressure is applied on it while it should also have enough resiliency to allow the tendon guard 56 to return to its initial position when pressure is no longer applied on it.

The skate boot 4 may also comprises medial and lateral lace members 58, 60 mounted to the medial and lateral upper edges 52, 54 of the medial and lateral side portions 48, 50 of the outer shell 6. The medial and lateral lace members 58, 60 may be made of fabric, textile, leather or plastic and comprise a series of medial and lateral apertures 62, 64 for receiving a lace. Eyelets may be punched into the lace apertures 62, 64 of lace members 58, 60.

The lace members 58, 60 can be mounted to the medial and lateral upper edges 52, 54 of the medial or lateral side portions 48, 50 of the outer shell 6 via any method known in the art such as stitching, overmolding, thermal bonding, high-frequency bonding, vibration bonding, piping, adhesive, or any combination thereof. In yet other embodiments, the lace members can form an integral part of the outer shell 6. In another embodiment, the lace members may be omitted and lace apertures and eyelets may be rather provided along the medial and lateral upper edges of the medial and lateral side portions of the outer shell. Medial and lateral bands or overlays may then be added to the outer shell in order to add rigidity to the skate boot in the lace regions.

As indicated previously, the skate boot 4 has the inner liner 16, which can be mounted to the outer shell 6 by lamination, stitches, glue, needles, overmolding, thermal bonding, high-frequency bonding, vibration bonding, ultrasonically bonded, or the like.

The inner liner 16 is made of a first material and comprises at least one covering, layer, patch or overlay made of a second material having more abrasion resistance than the first material of the inner liner.

The inner liner 16 may be made of different layers, for example an inner layer that is made of an air-pervious fabric and has an inner surface to contact the player's foot or sock in use, an intermediate cushioning layer made of a resilient cushioning material, and an outer layer that is co-extensive with the inner layer and cushioning layer and that is made of a water impervious material. The air-pervious fabric may be made of nylon fabric. The resilient cushioning material may be made vinyl foam.

In other examples, the inner liner 16 may be made of one or more layers of materials such as: anti-microbial, anti-fungal polypropylene, polyester or polyester blend having a polyester or cotton backing or the like; fabric or nonwoven made from corn fibers or a blend of corn fibers with acetate, polyvinyl acetate or polyester fibers; synthetic leathers; polyester fabrics; nonwoven fabrics, nonwoven wool blend;

polyester fabric with an active carbon compound bonded to the polyester; or sanded polyester microfiber material.

In another example, the inner liner 16 may be made of a layer of soft material such as a sheet of polyester laminated with a layer of foam, or of a layer of fabric made from nylon fibers. The inner liner 16 may also be made of brushed nylon fabric, nylon mesh, polyester mesh or synthetic leather.

Figure 7:
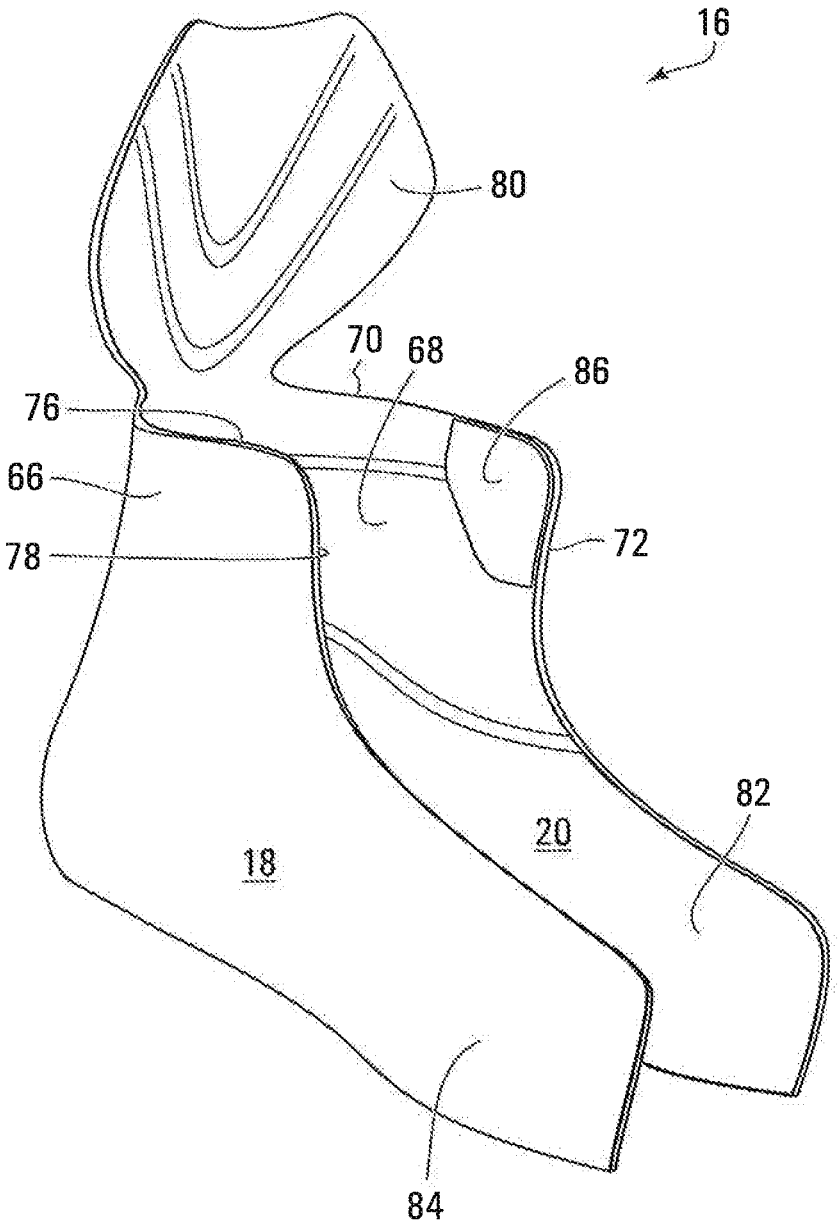
FIG. 7 is a perspective view of the inner liner in accordance with the first embodiment of the present invention.
Figure 8:
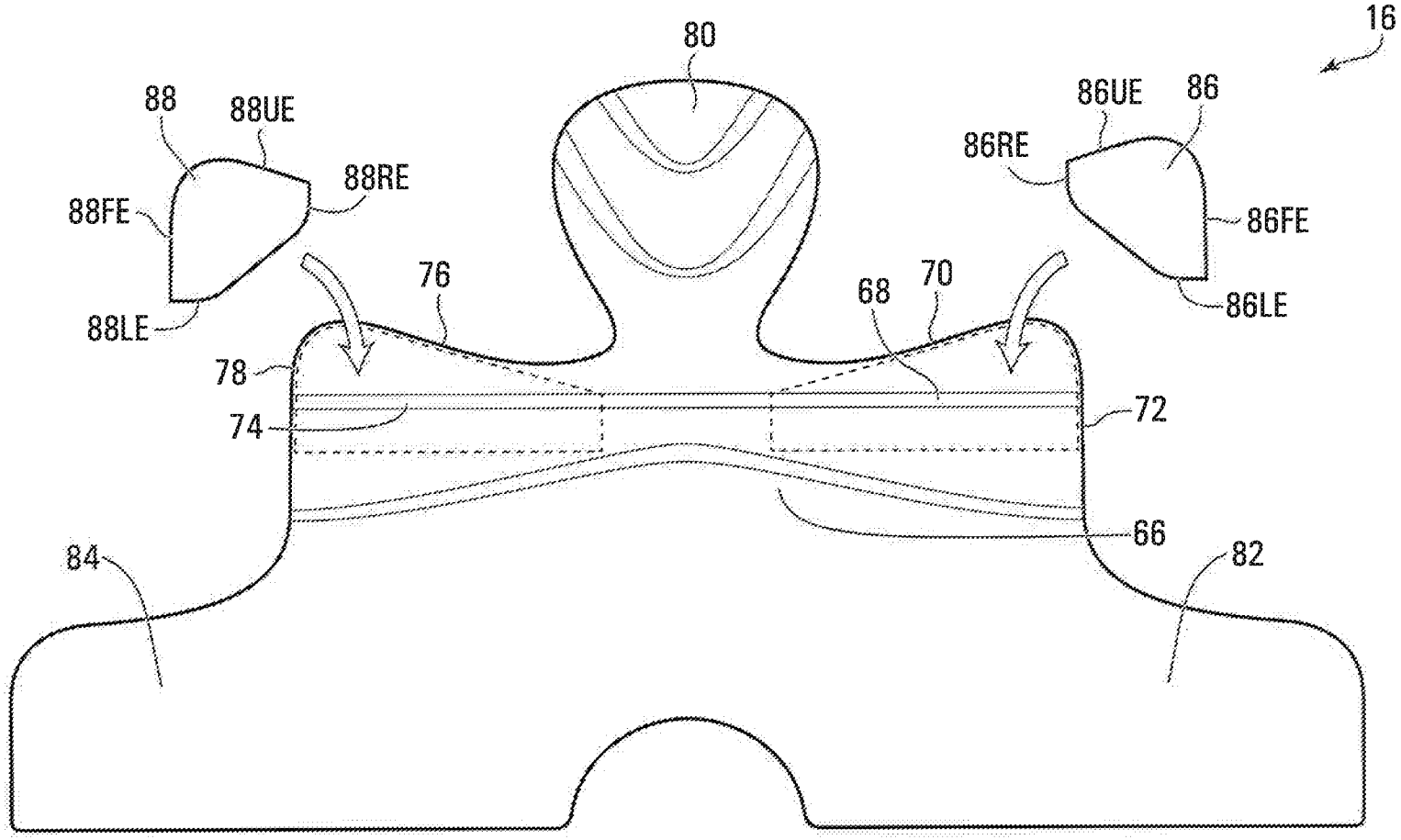
FIG. 8 is a top view of the inner liner of FIG. 7, with the liner shown in a flat position and with the medial and lateral overlays shown separately.
Figure 9:
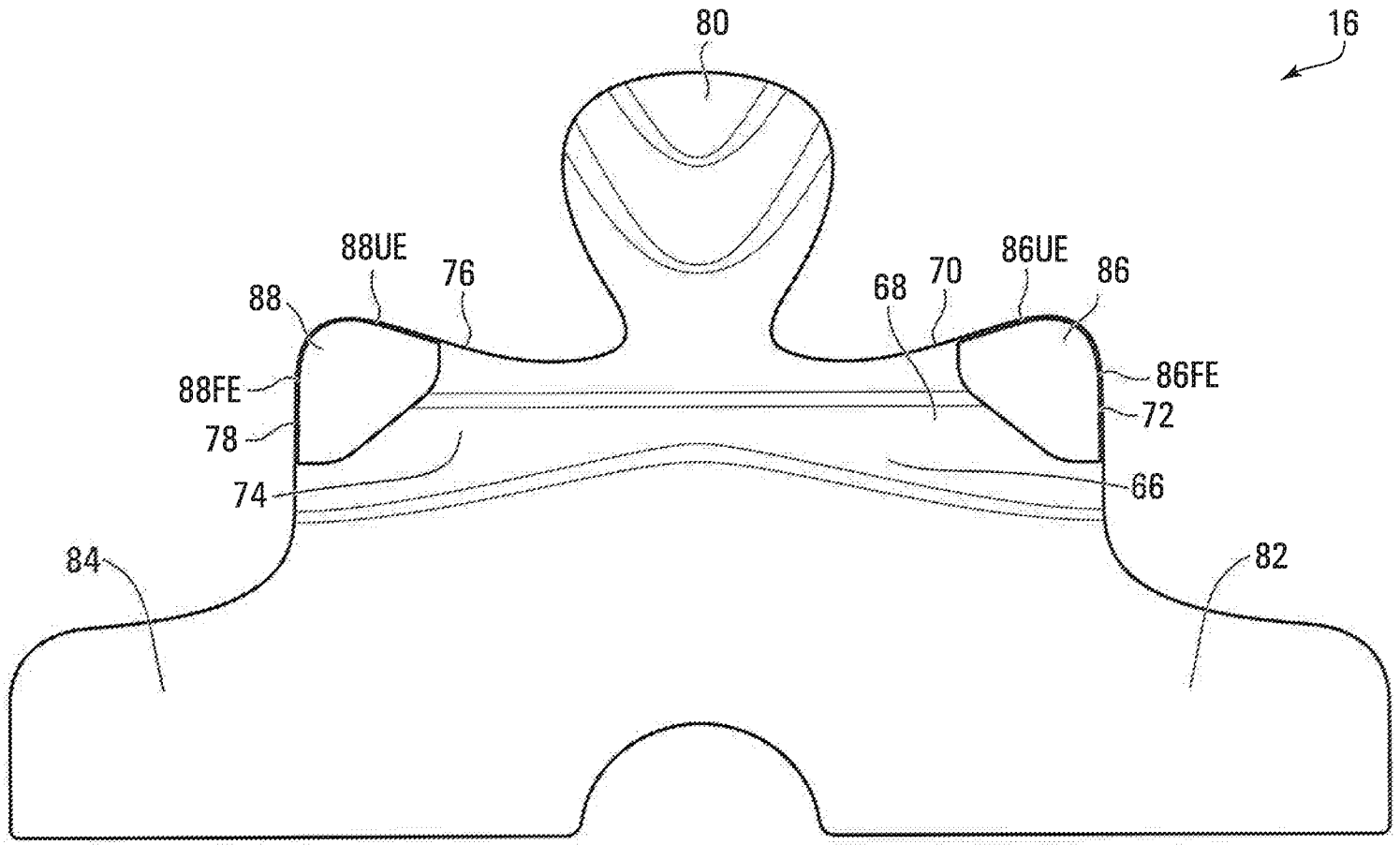
FIG. 9 is a top view of the inner liner of FIG. 7, with the inner liner shown in a flat position.

Referring to FIGS. 7 to 9, the inner liner 16 has an ankle portion 66 comprising a medial upper inner region 68, a medial upper edge 70, a medial front edge 72, a lateral upper inner region 74, a lateral upper edge 76 and a lateral front edge 78. The inner liner 16 may also comprise a tendon guard portion 80 for covering the inner surface of the tendon guard 56 and medial and lateral side portions 82, 84 for covering the inner surface of the medial and lateral side portions 48, 50 of the outer shell 6.

The inner liner 16 is made of a first material and comprises at least one covering, layer, patch or overlay made of a second material having more abrasion resistance than the first material of the inner liner, the overlay being located in an inner region of the liner 16 that is more exposed to friction from the tongue and/or leg pad covered by hockey sock. For example, the inner liner may have medial and lateral overlays 86, 88 generally covering the medial and lateral upper inner regions 68, 74 of the inner liner 16. The medial and lateral upper inner regions 68, 74 of the inner liner 16 may each be seen as a region occupying a substantial portion of the upper of the medial and lateral inner surfaces of the ankle portion 66 delimited by the upper edge and the front edges at both upper corner sides (see the trapezoids shown as broken lines in FIG. 8). While the medial and lateral overlays 86, 88 may cover about 20% to 30% of the medial and lateral upper inner regions 68, 74, it is understood that the overlays may also cover a smaller or larger percentage of these regions.

Figure 6:
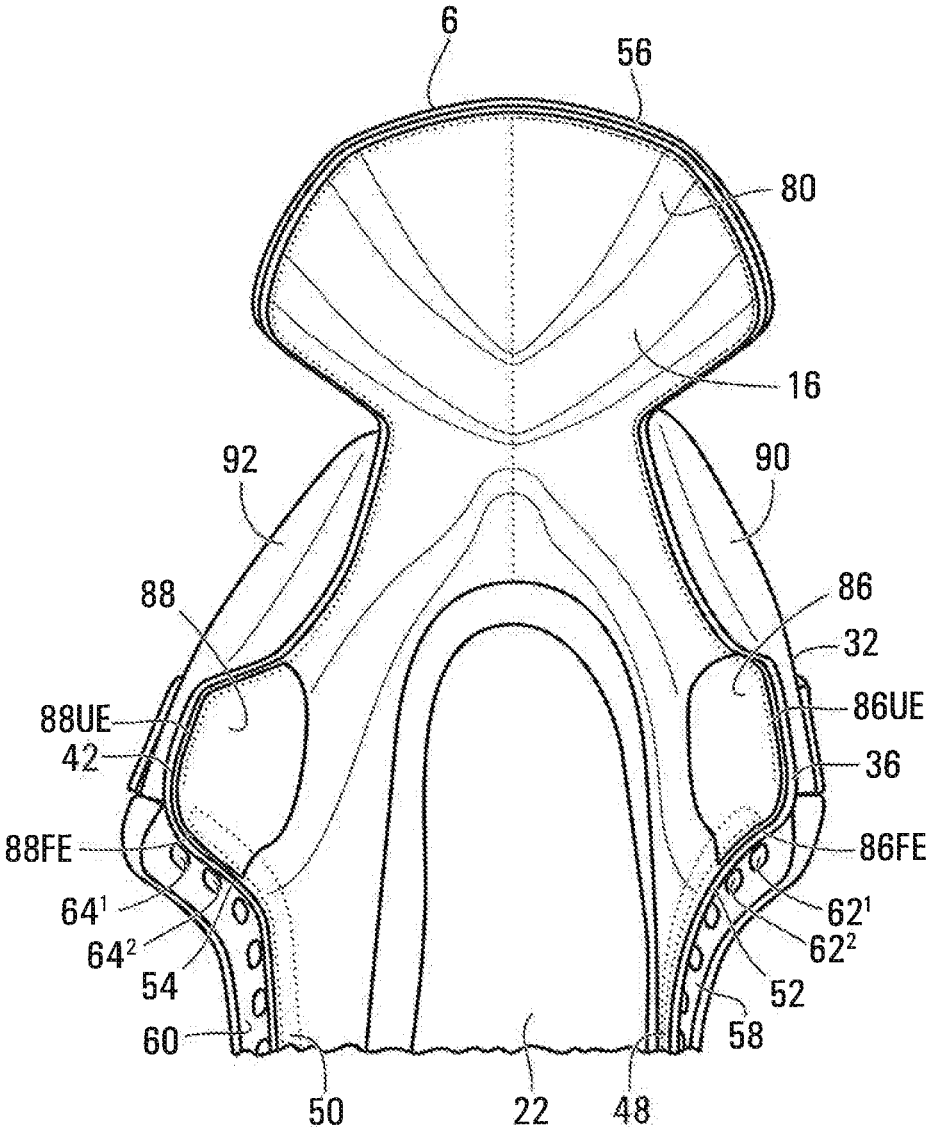
FIG. 6 is a partial enlarged top perspective view of the ice skate of FIG. 3.

The medial overlay 86 has upper, front, lower and rear edges 86UE, 86FE, 86LE, 86RE and the lateral overlay 88 has upper, front, lower and rear edges 88UE, 88FE, 88LE, 88RE, the upper edge 86UE of the medial overlay 86 being located adjacent the medial upper edge 70 of the inner liner ankle portion 66, the front edge 86FE of the medial overlay 86 being located adjacent the medial front edge 72 of the inner liner ankle portion 66, the upper edge 88UE of the lateral overlay 88 being located adjacent the lateral upper edge 76 of the inner liner ankle portion 66 and the front edge 88FE of the lateral overlay 88 being located adjacent the lateral front edge 78 of the inner, liner ankle portion 66. As is best seen in FIG. 6, with such a construction the upper edge 86UE of the medial overlay 86 is located adjacent the medial upper edge 36 of the shell ankle portion 32, the front edge 86FE of the medial overlay 86 is located adjacent the upper edge 52 of the shell medial side portion 48 (and adjacent the first and second lace openings $\mathbf{62}^1$, $\mathbf{62}^2$), the upper edge 88UE of the lateral overlay 88 is located adjacent the lateral upper edge 42 of the shell ankle portion 32, and the front edge 88FE of the lateral overlay 88 is located adjacent the upper edge 54 of the shell lateral side portion 50 (and adjacent the first and second lace openings $\mathbf{64}^1$, $\mathbf{64}^2$).

While the inner liner 16 has medial and lateral overlays 86, 88, it is understood that one overlay may be omitted such that the inner liner only comprises one overlay located on the inner region that may be more exposed to friction (the lateral inner region for example).

The medial and lateral overlays 86, 88 may be mounted or affixed to the medial and lateral upper inner regions 68, 74 of the inner liner 16 using any method known in the art such as lamination, stitching, gluing, needling, overmolding, thermal bonding, high-frequency bonding, vibration bonding, ultra-sonically bonding or any combination thereof.

Moreover, the medial and lateral overlays 86, 88 may be made of any suitable material offering more abrasion resistance than the remaining material of the inner liner 16, such as thermoplastic polyurethane, polyurethane, denier nylon, denier cordura, ballistic nylon, rubber or neoprene.

For example, the medial and lateral overlays 86, 88 may be made of a thermoplastic to polyurethane film or layer bonded to the inner surface 20 of the inner liner 16 by high-frequency bonding at a temperature between 90° C. and 100° C. and at a pressure between 4 and 5 kg/cm$^2$ for about two minutes with a cooling period of about one minute.

The medial and lateral overlays 86, 88 may each have a thickness between 0.3 mm and 0.7 mm.

Figure 10:
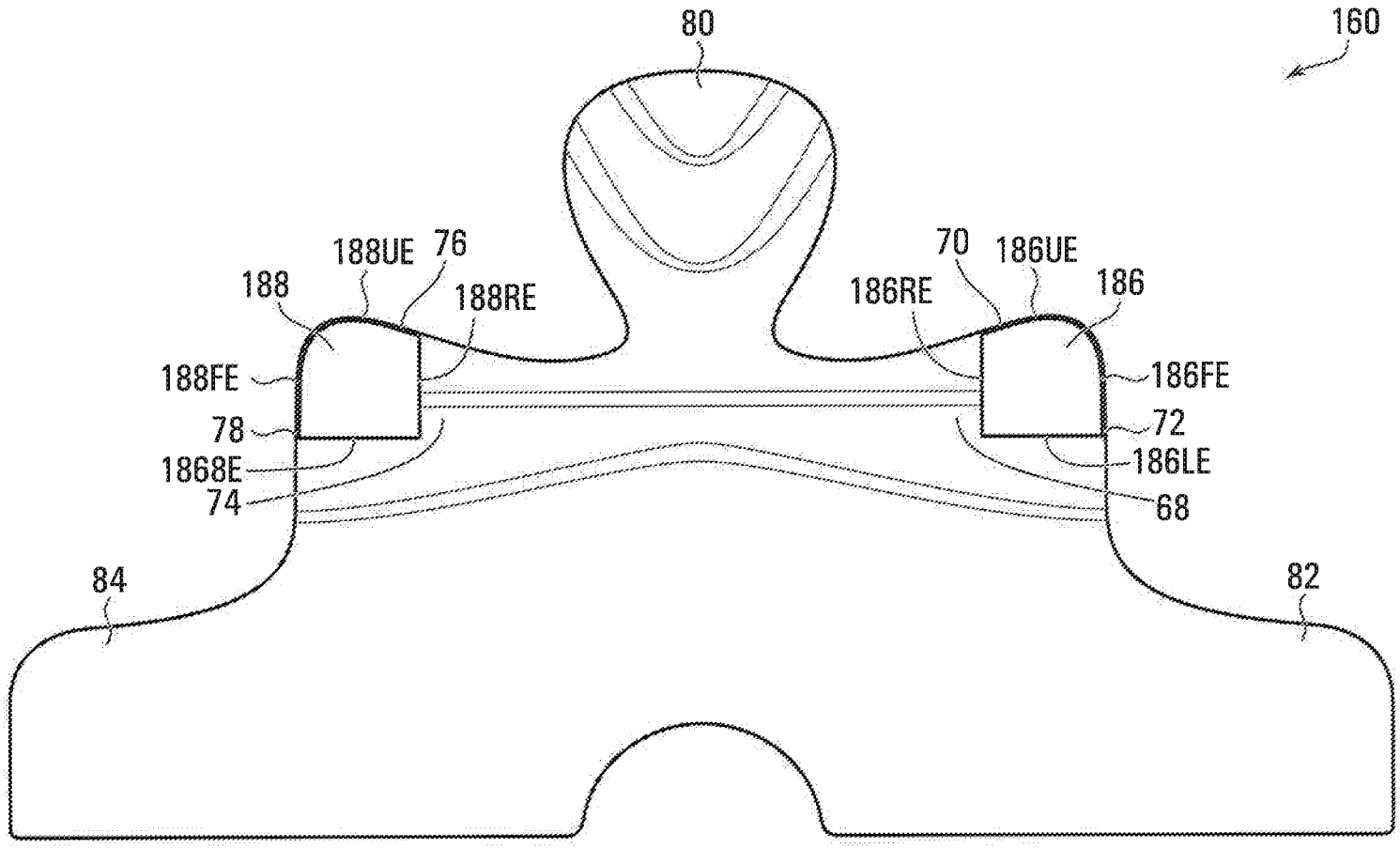
FIG. 10 is a top view of an inner liner in accordance with a second embodiment of the present invention, with the liner shown in a flat position.

An inner liner 160 in accordance with a second embodiment of the invention is shown in FIG. 10 in which the same reference numerals are used for the same elements as those for the inner liner 16. The inner liner 160 has medial and lateral overlays 186, 188 generally covering the medial and lateral upper inner regions of the inner liner 160. The medial overlay 186 has upper, front, lower and rear edges 186UE, 186FE, 186LE, 186RE and the lateral overlay 188 has upper, front, lower and rear edges 188UE, 188FE, 188LE, 188RE, the upper edge 186UE of the medial overlay 186 being located adjacent the medial upper edge of the inner liner ankle portion, the front edge 186FE of the medial overlay 186 being located adjacent the medial front edge of the inner liner ankle portion, the upper edge 188UE of the lateral overlay 188 being located adjacent the lateral upper edge of the inner liner ankle portion and the front edge 188FE of the lateral overlay 188 being located adjacent the lateral front edge of the inner liner ankle portion. The rear edges 186RE, 188RE each extends along an axis generally parallel to the vertical and the lower edges 186LE, 188LE each extends along an axis generally parallel to the horizontal.

Figure 11:
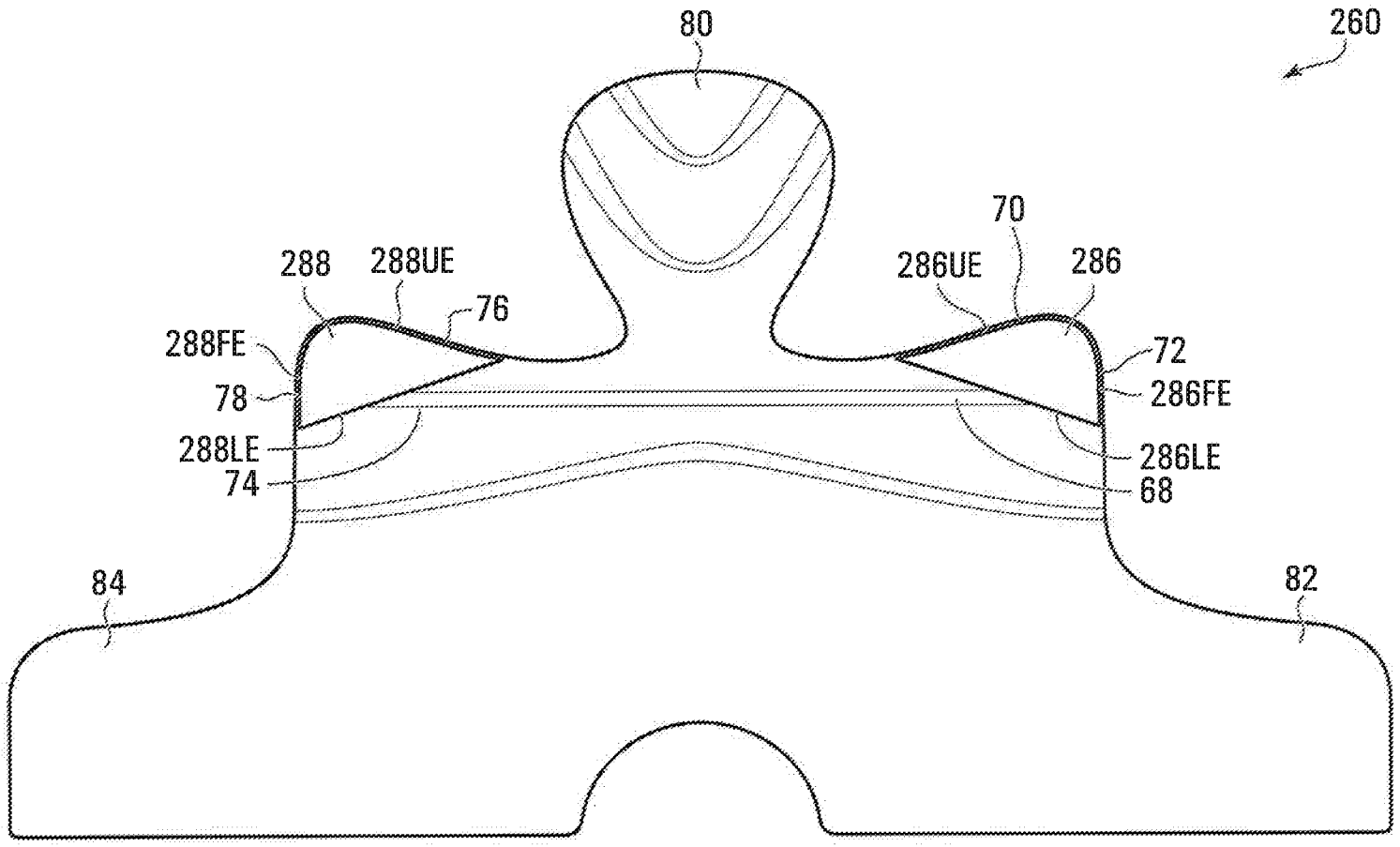
FIG. 11 is a top view of an inner liner in accordance with a third embodiment of the present invention, with the liner shown in a flat position.

An inner liner 260 in accordance with a third embodiment of the invention is shown in FIG. 11 in which the same reference numerals are used for the same elements as those for the inner liner 16. The inner liner 260 has medial and lateral overlays 286, 288 generally covering the medial and lateral upper inner regions of the inner liner 260. The medial overlay 286 has upper, front and lower edges 286UE, 286FE, 186LE and the lateral overlay 288 has upper, front and lower edges 288UE, 288FE, 288LE, the upper edge 286UE of the medial overlay 286 being located adjacent the medial upper edge of the inner liner ankle portion, the front edge 286FE of the medial overlay 286 being located adjacent the medial front edge of the inner liner ankle portion, the upper edge 288UE of the lateral overlay 288 being located adjacent the lateral upper edge of the inner liner ankle portion and the front edge 288FE of the lateral overlay 288 being located adjacent the lateral front edge of the inner liner ankle portion. The lower edges 286LE, 288LE each extends along an axis generally transversal to the vertical.

Figure 12:
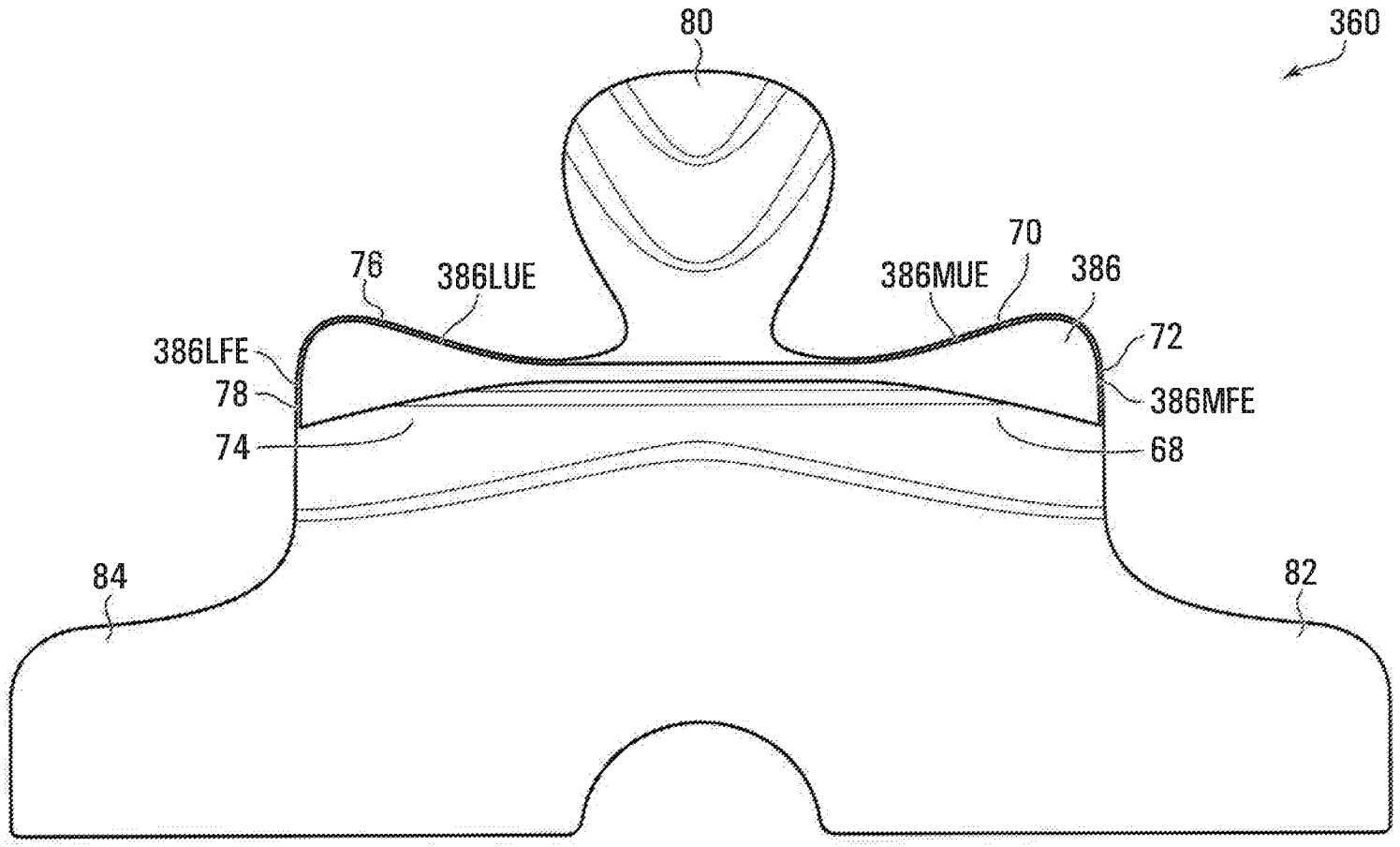
FIG. 12 is a top view of an inner liner in accordance with a fourth embodiment of the present invention, with the liner shown in a flat position.

An inner liner 360 in accordance with a fourth embodiment of the invention is shown in FIG. 12 in which the same reference numerals are used for the same elements as those for the inner liner 16. The inner liner 360 has an overlay 386 constituting a single unitary piece covering the medial and lateral upper inner regions and a portion of the upper inner middle region of the inner liner 360. The overlay 386 includes a first enlarged section covering the medial upper inner region of the inner liner 360. The first enlarged section of the overlay 386 has a medial upper edge 386MUE located adjacent the medial upper edge of the inner liner ankle portion, and a medial front edge 386MFE located adjacent the medial front edge of the inner liner ankle portion. The overlay 386 further includes a second enlarged section covering the lateral upper inner region of the inner liner 360. The second enlarged section of the overlay 386 has a lateral upper edge 388LUE located adjacent the lateral upper edge of the inner liner ankle portion, and a lateral front edge 288LFE located adjacent the lateral front edge of the inner liner ankle portion. The first enlarged section and the second enlarged section of the overlay 386 are connected by a further section of the overlay 386 that wraps around an ankle portion of the inner liner 360.

Figure 13:
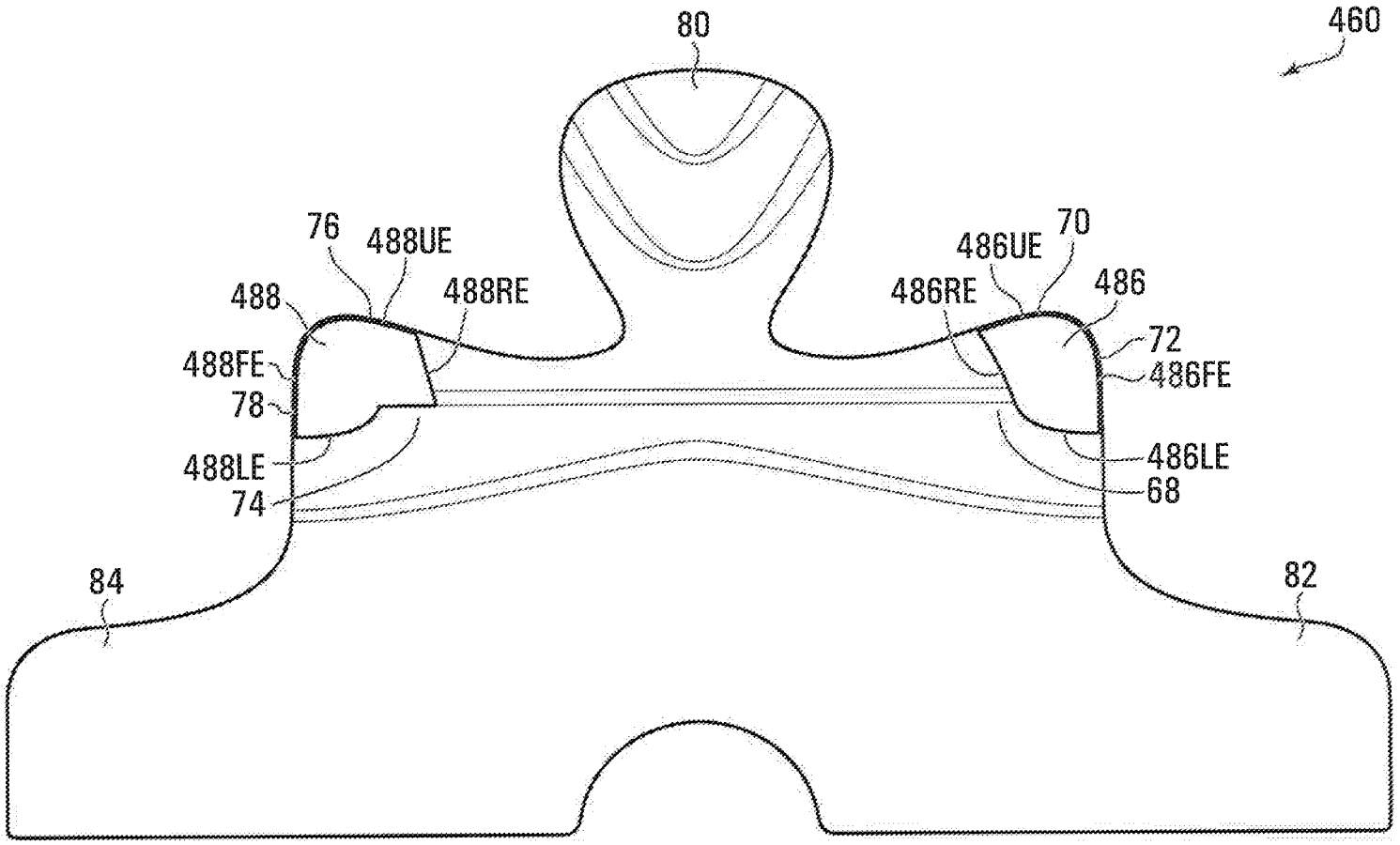
FIG. 13 is a top view of an inner liner in accordance with a fifth embodiment of the present invention, with the liner shown in a flat position.

An inner liner 460 in accordance with a fifth embodiment of the invention is shown in FIG. 13 in which the same reference numerals are used for the same elements as those for the inner liner 16. The inner liner 460 has medial and lateral overlays 486, 488 generally covering the medial and lateral upper inner regions of the inner liner 460. The medial overlay 486 has upper, front, lower and rear edges 486UE, 486FE, 486LE, 486RE and the lateral overlay 488 has upper, front, lower and rear edges 488UE, 488FE, 488LE, 488RE, the upper edge 486UE of the medial overlay 486 being located adjacent the medial upper edge of the inner liner ankle portion, the front edge 486FE of the medial overlay 486 being located adjacent the medial front edge of the inner liner ankle portion, the upper edge 488UE of the lateral overlay 488 being located adjacent the lateral upper edge of the inner liner ankle portion and the front edge 488FE of the lateral overlay 488 being located adjacent the lateral front edge of the inner liner ankle portion. The rear edge 488RE of the lateral overlay 488 is located more inwardly than the rear edge 486RE of the medial overlay 486 such that the lateral overlay 488 covers a larger region than the medial overlay 486.

As is best seen in FIGS. 3 to 5, the skate boot 4 may also comprises medial and lateral ankle layers, coverings or overlays 90, 92 for covering the medial and lateral upper edges 70, 76 of the liner 16 and the medial and lateral upper edges 36, 42 of the ankle portion 32 of the outer shell 6. These medial and lateral overlays 90, 92 may be made of natural or synthetic leather and may add comfort to the player in the ankle region, especially during the breaking-in process of the skate boot 4. The skate boot 4 may also comprise a heel layer, covering or overlay 94 for at least partially covering the heel portion 30 of the outer shell and medial and lateral side layers, coverings or overlays 96 for at least partially covering the front portion of the medial and lateral side portions 48, 50 of the outer shell 6.

The above description of the embodiments should not be interpreted in a limiting manner since other variations, modifications and refinements are possible within the scope of the present invention. The scope of the invention is defined in the appended claims and their equivalents.

The invention claimed is:

1. A liner for a skate boot, the liner forming a foot-receiving cavity, the liner comprising an ankle portion that comprises an upper edge and a front edge, the liner comprising an outer surface and an inner surface, the outer surface configured to be mounted to a shell of the skate boot, the inner surface facing an interior of the foot-receiving cavity and comprising a first material to which is mounted an overlay of a second material, the overlay comprising an upper edge and a front edge, the upper edge of the overlay being located adjacent the upper edge of the ankle portion of the liner, the front edge of the overlay being located adjacent (i) the front edge of the ankle portion of the liner; and (ii) lace members of the skate boot, the lace members comprising lace apertures, wherein the second material of the overlay is thinner than the first material of the inner surface of the liner; and wherein the overlay and part of the first material not covered by overlay being exposed to the interior of the foot-receiving cavity.

2. The liner defined in claim 1, wherein the overlay spans an area exposed to friction from a foot when the foot is placed in the skate boot, wherein the part of the first material covered by overlay corresponds to an entirety of said area.

3. The liner defined in claim 1, wherein the second material comprises polyurethane, denier nylon, denier cordura, ballistic nylon, rubber or neoprene.

4. The liner defined in claim 1, wherein the overlay comprises a thermoplastic polyurethane film bonded onto the first material.

5. The liner defined in claim 1, wherein the overlay is a first overlay, the liner further comprising a second overlay of said second material.

6. The liner defined in claim 5, wherein the upper edge of the ankle portion is a medial upper edge, the ankle portion of the liner further comprising a lateral upper edge, wherein the front edge of the ankle portion is a medial front edge, the ankle portion of the liner further comprising a lateral front edge, and wherein the upper edge of the first overlay is located adjacent the medial upper edge of the ankle portion and a front edge of the first overlay is located adjacent the medial front edge of the ankle portion and the second overlay has an upper edge located adjacent the lateral upper edge of the ankle portion and a front edge located adjacent the lateral front edge of the ankle portion.

7. The liner defined in claim 1, wherein the overlay has a thickness less than 0.7 mm.

8. The liner defined in claim 7, wherein the overlay has a thickness greater than 0.3 mm.

9. The liner defined in claim 1, wherein the first material includes brushed nylon fabric, nylon mesh, polyester mesh or synthetic leather.

10. The liner defined in claim 1, wherein the overlay is mounted to the first material by lamination, stitches, glue, needles, overmolding, thermal bonding, high-frequency bonding, vibration bonding, or ultra-sonic bonding.

11. The liner defined in claim 1, wherein the part of the first material covered by overlay occupies an area of the inner surface that is smaller than the area occupied on the inner surface by a remainder of the first material that is not covered by overlay.

12. The liner defined in claim 1, wherein at least part of the overlay is along a periphery of the liner.

13. The liner defined in claim 1, wherein at least part of a perimeter of the overlay is curved.

14. The liner defined in claim 1, wherein the overlay comprises a first section at least partly covering a medial upper inner portion of the liner and a second section at least partly covering a lateral upper inner portion of the liner.

15. The liner defined in claim 14, wherein the first section occupies between 20% and 30% of the medial upper inner portion of the liner and the second section occupies between 20% and 30% of the lateral upper inner portion of the liner.

16. The liner defined in claim 1, wherein the overlay protects the part of the first material that is under the overlay against abrasion from an object inside the skate boot.

17. The liner defined in claim 1, wherein the overlay comprises a single unitary piece at least partly covering both a medial upper inner portion of the liner and a lateral upper inner portion of the liner.

18. The liner defined in claim 17, wherein the single unitary piece includes a first enlarged section connected to a second enlarged section by a strip that wraps around an ankle portion of the liner, the first enlarged section at least partly covering the medial upper inner portion of the liner and the second enlarged section at least partly covering the lateral upper inner portion of the liner.

19. The liner defined in claim 1, wherein the second material has more abrasion resistance than the first material.

20. The liner defined in claim 1, wherein the second material is a polymeric material.

21. The liner defined in claim 1, wherein an entirety of the overlay covers the part of the first material covered by the overlay.

22. A skate boot comprising (i) lace members including lace apertures;

(H) a liner comprising an ankle portion that comprises an upper edge and a front edge, the liner having an inner surface and an exterior surface, the inner surface forming a foot-receiving cavity; and (iii) a shell mounted to exterior surface of the liner; wherein the inner surface of the liner comprises a first material, at least part of the first material being covered by a layer of a second material, the layer of second material comprising an upper edge and a front edge, the upper edge of the layer of second material being located adjacent the upper edge of the ankle portion of the liner, the front edge of the layer of second material being located adjacent (i) the front edge of the ankle portion of the liner; and (ii) the lace apertures of the skate boot, wherein the layer of second material is thinner than the first material of the inner surface of the liner; and wherein the layer of second material and another part of the first material not covered by the layer of second material being exposed to an interior of the foot-receiving cavity.

23. A skate boot comprising (i) lace members including lace apertures; (ii) a shell; and (iii) a liner, the liner forming a foot-receiving cavity, the liner comprising an ankle portion that comprises an upper edge and a front edge, the liner comprising, an outer surface and an inner surface, the outer surface configured to be mounted to the shell of the skate boot, the inner surface facing an interior of the foot-receiving cavity and comprising a first material to which is mounted an overlay of a second material, the overlay comprising an upper edge and a front edge, the upper edge of the overlay being located adjacent the upper edge of the ankle portion of the liner, the front edge of the overlay being located adjacent (i) the front edge of the ankle portion of the liner; and (ii) the lace apertures of the skate boot, wherein the second material of the overlay is thinner than the first material of the inner surface of the liner; and wherein the overlay and part of the first material not covered by overlay being exposed to the interior of the foot-receiving cavity.

* * * * *